US010376066B2

(12) United States Patent
Su

(10) Patent No.: US 10,376,066 B2
(45) Date of Patent: Aug. 13, 2019

(54) FLEXIBLE SUPPORT DEVICE FOR CHAIR BACK TILTING

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 0 days.

(21) Appl. No.: 15/832,613

(22) Filed: Dec. 5, 2017

(65) Prior Publication Data

US 2019/0090647 A1 Mar. 28, 2019

(30) Foreign Application Priority Data

Sep. 22, 2017 (CN) ..... 2017 1 0863199

(51) Int. Cl.
*A47C 7/44* (2006.01)

(52) U.S. Cl.
CPC ..... *A47C 7/441* (2013.01); *A47C 7/443* (2013.01)

(58) Field of Classification Search
CPC ..... A47C 7/441; A47C 7/443
See application file for complete search history.

(56) References Cited

U.S. PATENT DOCUMENTS

| | | | | |
|---|---|---|---|---|
| 4,652,050 | A * | 3/1987 | Stevens | A47C 3/026 297/302.4 |
| 6,039,398 | A * | 3/2000 | Gorgi | A47C 1/025 297/301.4 |
| 7,014,262 | B2 * | 3/2006 | Rossetto | A47C 1/03238 297/300.8 |
| 7,147,285 | B2 * | 12/2006 | Lin | A47C 1/026 297/301.1 |
| 7,614,697 | B1 * | 11/2009 | Lai | A47C 1/03255 297/301.1 |
| 7,946,651 | B2 * | 5/2011 | Donati | A47C 1/025 297/285 |
| 9,414,680 | B2 * | 8/2016 | Su | A47C 1/03272 |
| 9,894,999 | B2 * | 2/2018 | Bock | A47C 1/03255 |
| 9,974,389 | B2 * | 5/2018 | Sander | A47C 7/441 |
| 2015/0282620 | A1 * | 10/2015 | Bock | A47C 1/03211 297/342 |

* cited by examiner

*Primary Examiner* — Philip F Gabler

(57) ABSTRACT

The flexible support device is used for chair back tilting, which is installed under a cushion. The device includes a base, two driving members connected to the chair back, a pulling rod crossing the base and a spring disposed in the base. The base is connected to ends of the driving members. Two ends of the pulling rod are separately connected to two free ends of the two driving members. The pulling rod has a frame encompassing the spring. The frame has an action end blocking the spring. When the chair back is pressed to tilt rearward, the driving members are rotated to draw the pulling rod to move toward the chair back, and the action end of the frame is driven to compress the spring so as to make the chair back flexibly supported.

9 Claims, 8 Drawing Sheets

FLEXIBLE SUPPORT DEVICE FOR CHAIR BACK TILTING

BACKGROUND OF THE INVENTION

1. Technical Field

The invention relates to chairs, particularly to flexible tilting support to a chair back.

2. Related Art

Rearward tilting chair backs helps users to obtain comfortable sitting. But such rearward tilting must be flexible supported to avoid flaccidness. In addition, the flexibility of rearward tilting cannot be hard enough to cause difficulties of operation and use. However, control of the flexibility is a considerably difficult issue for furniture industry.

FIG. 1 shows an existing flexible support and flexibility adjustment structure. It uses an end of an adjusting rod 60 to screw up to a driven block 62. A transmission rod 63 is arranged on a base 61. The transmission rod 63 is axially connected to the driven block 62 through a link set 65. A spring 64 is put around the transmission rod 63. The other end of the base 61 is provided with a driving member 66 connected to the chair back. An end of the spring 64 is stopped by an end of the driving member 66. When the chair back is tilted rearward, the driving member 66 directly compresses the spring 64 to obtain flexible support. Additionally, by the connective move of the driven block 62 and the transmission rod 63, the transmission rod 63 shifts to change elasticity of the spring 64 to obtain desired flexibility adjustment.

In such a structure, the chair back is flexibly supported by the driving member 66 directly exerting a force onto the spring 64. However, the distance between the effort point and spring 64 is short in length, so a larger force is required to compress the spring 64. It really causes a difficulty in operation.

Moreover, the link set 65 has to change the force direction between the adjusting rod 60 and the transmission rod 63. If the link set 65 jams or has other rotational resistance, then the whole structure will malfunction. Also, the link set 65 transfers the force to the transmission rod 63 through one side, so unbalance is easy to occur to cause deflection of shift of the transmission rod 63 and structural damage.

SUMMARY OF THE INVENTION

An object of the invention is to provide a flexible support device for chair back tilting, which can offer enough flexibility and stability to a chair back to make users feel comfortable.

Another object of the invention is to provide a flexible support device for chair back tilting, which can save a user's effort to press the chair back.

To accomplish the above objects, the invention provides a flexible support device for chair back tilting, which includes a base, two driving members connected to the chair back, a pulling rod crossing the base and a spring disposed in the base. The base is connected to ends of the driving members. Two ends of the pulling rod are separately connected to two free ends of the two driving members. The pulling rod has a frame encompassing the spring. The frame has an action end blocking the spring. When the chair back is pressed to tilt rearward, the driving members are rotated to draw the pulling rod to move toward the chair back, and the action end of the frame is driven to compress the spring so as to make the chair back flexibly supported.

DETAILED DESCRIPTION OF THE INVENTION

Figure 1:
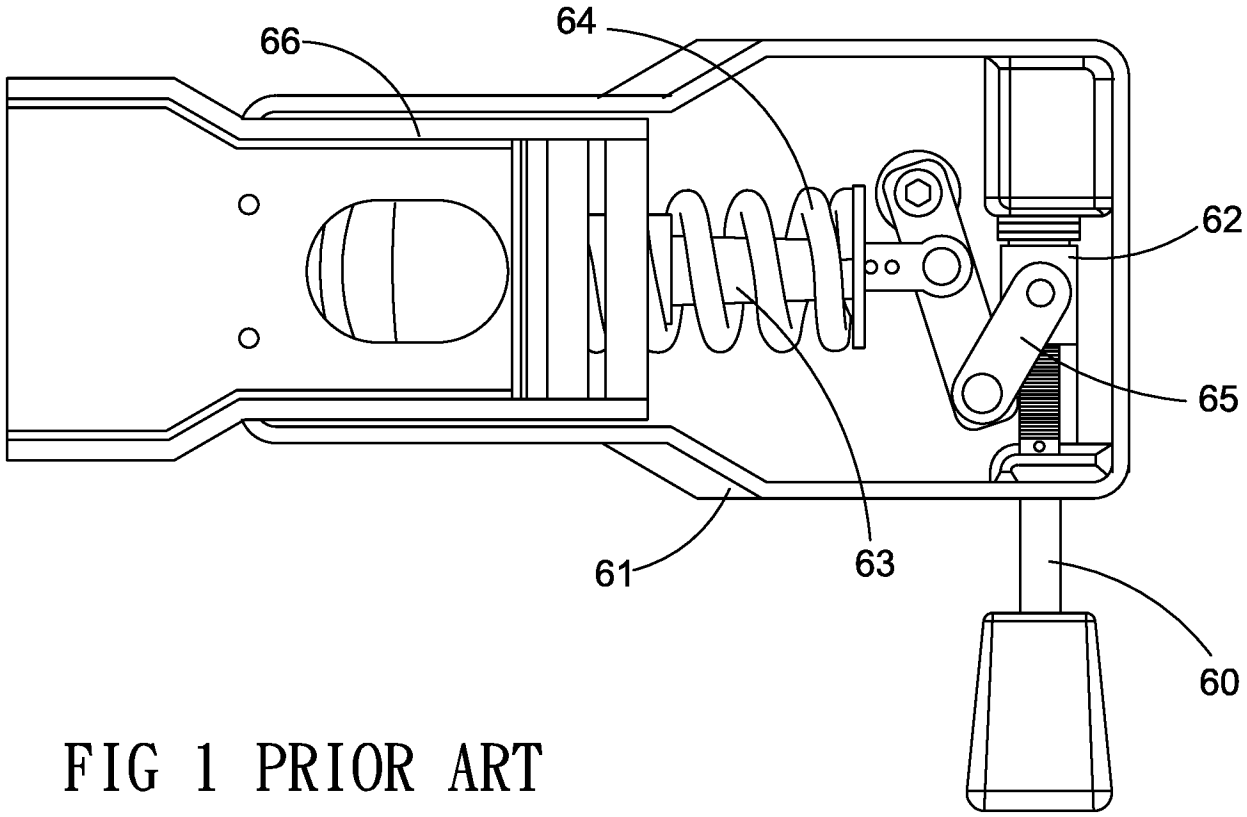
FIG 1 PRIOR ART
FIG. 1 is a schematic view of the prior art.
Figure 2:
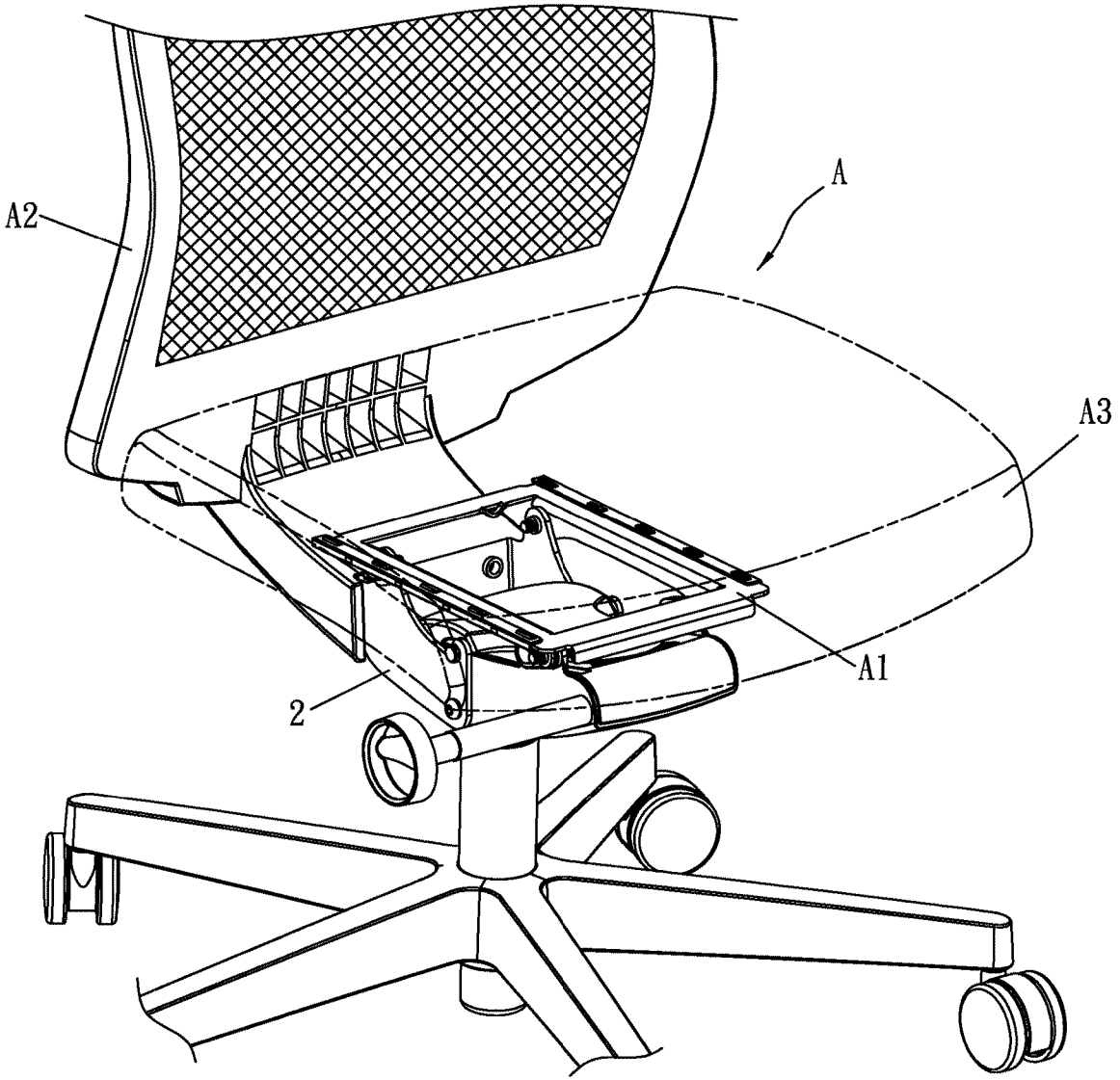
FIG. 2 is a schematic view of the invention assembled in a chair.
Figure 3:
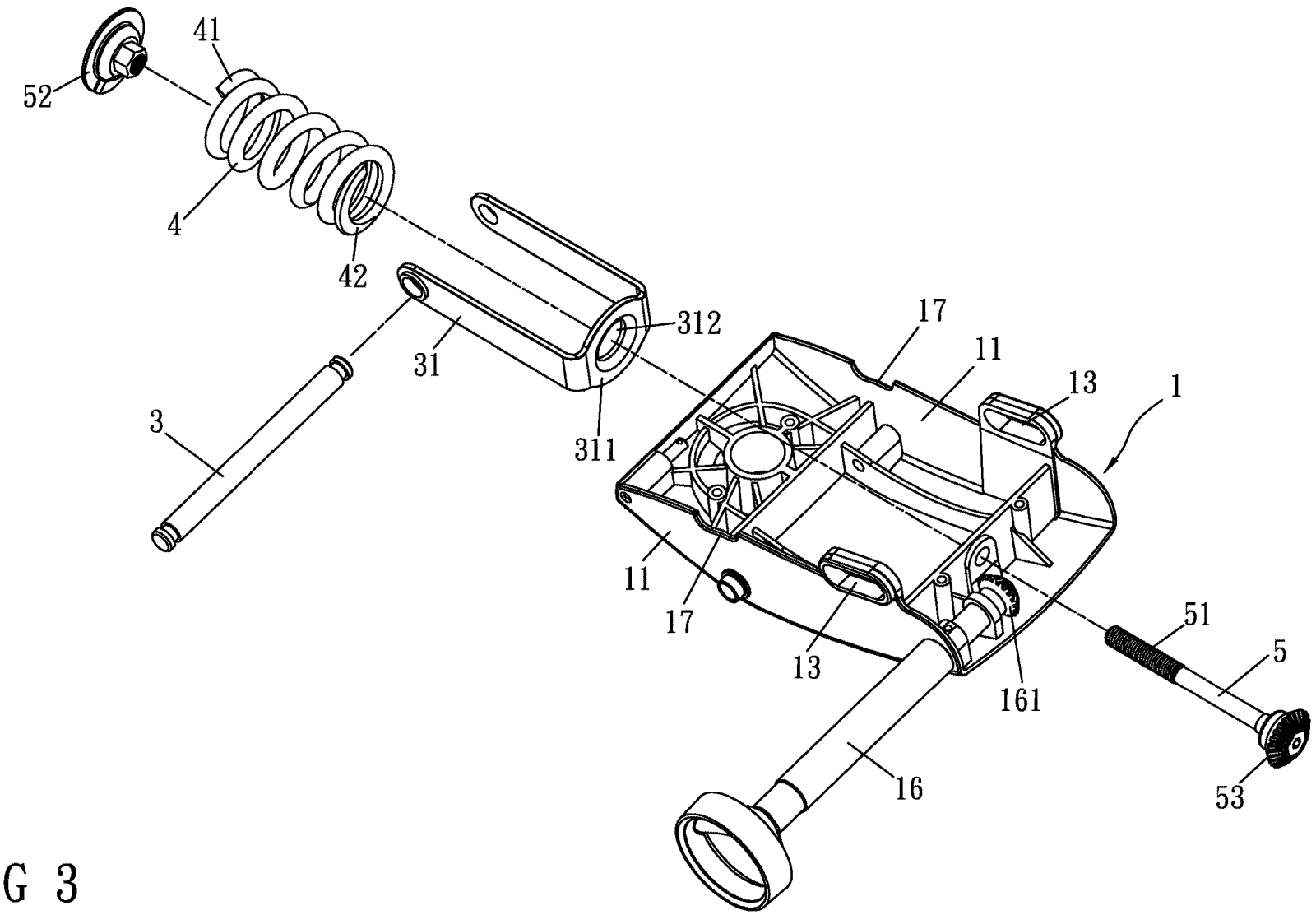
FIG. 3 is an exploded view of the invention.
Figure 4:
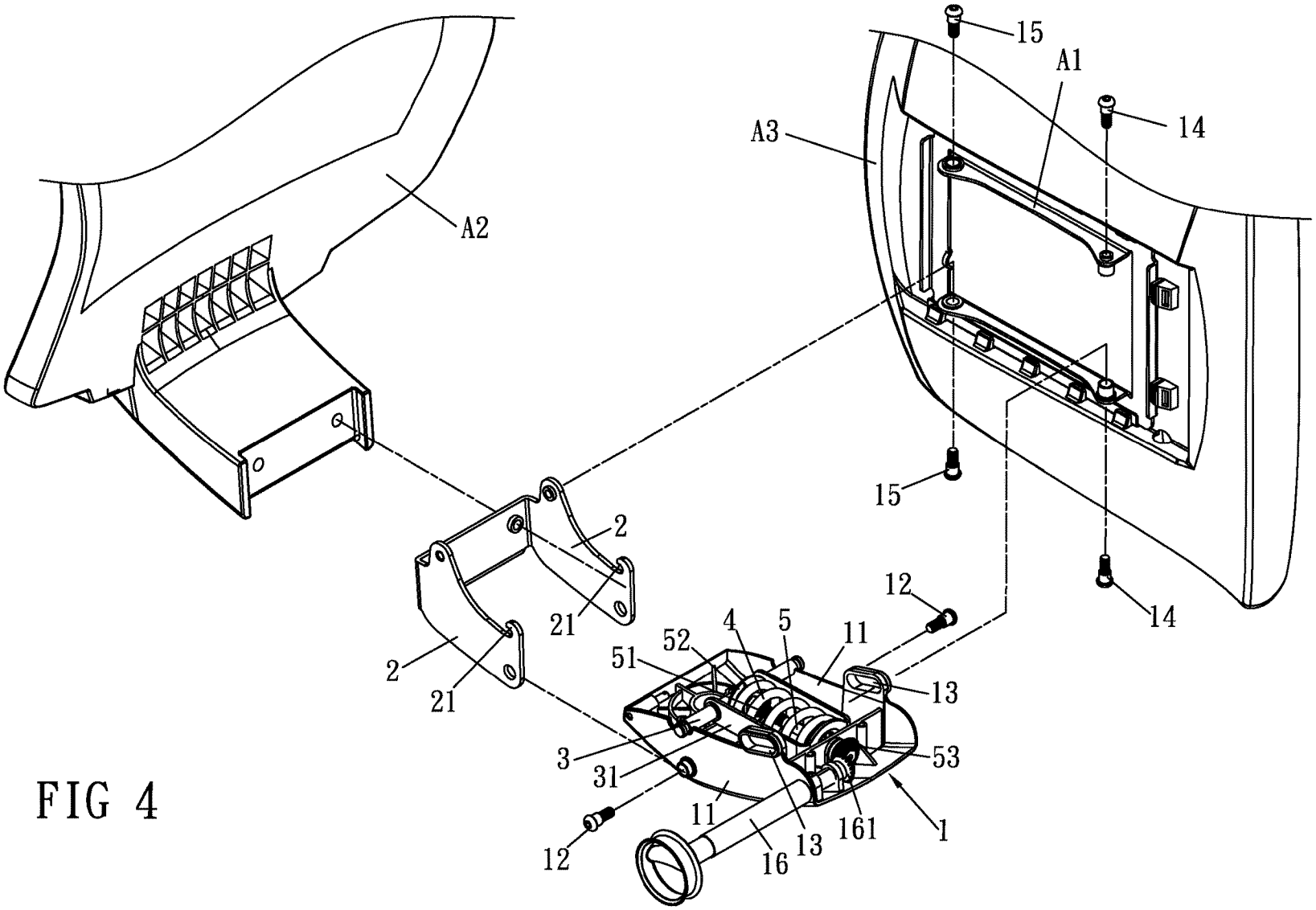
FIG. 4 is an assembled view of the invention, which shows relationship between the invention and the chair.

Please refer to FIGS. 2-4. The invention provides a flexible support device is used for chair back tilting, which is installed under a cushion A3 of a chair A. In other words, the invention is connected between a chair back A2 and the cushion A3. The device includes a base 1, a pair of driving members 2 connected to the chair back A2, a pulling rod 3 crossing the base 1, a spring 4 disposed in the base 1 and a shaft 5 for supporting the spring 4. Preferably, the bottom of the cushion A3 is further provided with a metal chassis A1.

Figure 5:
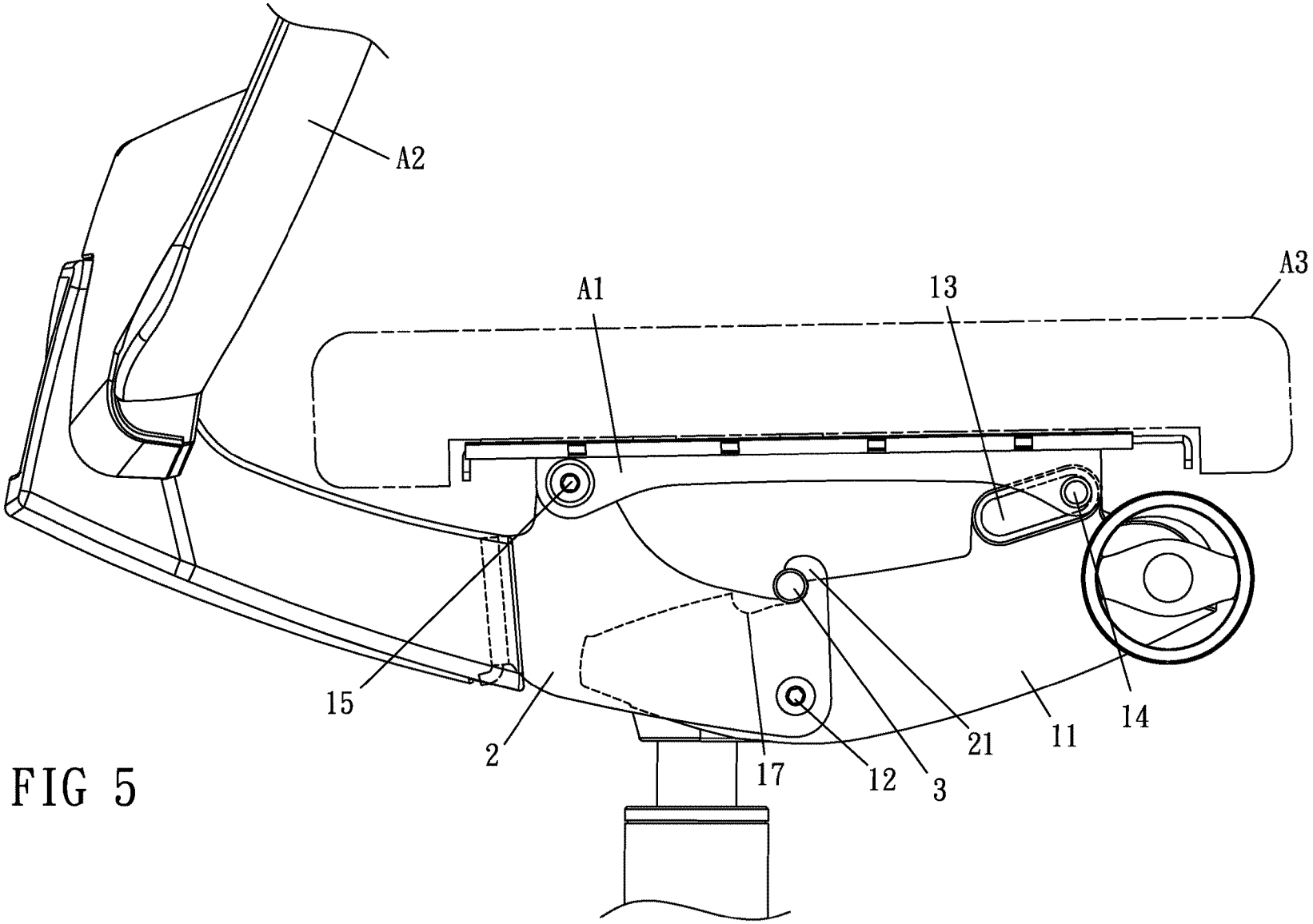
FIG. 5 is a side view of the invention installed in a chair.

The base 1 has a pair of partition plates 11. Each of ends of the partition plates 11 corresponds to one of the driving members 2. Each of the driving members 2 is pivotally connected to one of the partition plates 11 with a first pivot 12 to make them rotatable. Each of the partition plates 11 is formed with a guiding hole 13 which is located away from the driving members 2. Each of the guiding holes 13 is passed by a second pivot 14 to connect with the bottom of the cushion A3 or the metal chassis A1. A width of the guiding hole 13 is wider than a diameter of the second pivot 14 so that the second pivot 14 can freely move in the guiding hole 13. Two outer ends of the driving members 2 are pivotally connected to the bottom of the cushion A3 or the metal chassis A1 with a third pivot 15 to make the driving members 2 rotatable relative to the cushion A3. Please further refer to FIG. 5. The first pivot 12 is lower than the second pivot 14 and the third pivot 15 in position. When the chair back A2 is tilted rearward, the first pivot 12 serves as a fulcrum so as to make the cushion A3 move against the base 1.

The shaft 5 is disposed in the base 1. The spring 4 is put around the shaft 5. Preferably, an end of the shaft 5 is formed with a thread 51 for threadedly connecting a pressing disk 52 which blocks an end 41 of the spring 4. By rotating the shaft 5, the thread 51 can change the position of the pressing disk 52 so as to change a compression ratio of the spring 4. As a result, an extent of elasticity of the spring 4 can be controlled. The other end of the shaft 5 is provided with a passive gear 53.

The pulling rod 3 has a frame 31 encompassing the spring 4. The frame 31 has an action end 311 blocking the other end 42 of the spring 4. When the pulling rod 3 is activated, the action end 311 can press the spring 4. The action end 311 is further formed with a through hole 312 for assembling the frame 31 into the base 1. Two ends of the pulling rod 3 are connected to free ends of the driving members 2. Preferably, the free ends of the driving members 2 are formed with hooks 21 for hooking the pulling rod 3. As a result, the pulling rod 3 can be drawn to move toward the chair back A2 when the driving members 2 are being rotated.

On the other hand, moving of the pulling rod 3 also drives the action end 311 of the frame 31 to compress the spring 4 to generate flexible support to the chair back A2. Preferably, two limiting troughs 17 corresponding to the pulling rod 3 are formed in the base 1 to receive the pulling rod 3 so as to limit the pulling rod 3. Because the position of the pulling rod 3 can be changed, a width of the limiting trough 17 must be larger than a diameter of the pulling rod 3. In other words, the width of the limiting trough 17 sets limits of moving of the pulling rod 3 to avoid extensively tilting.

Figure 6:
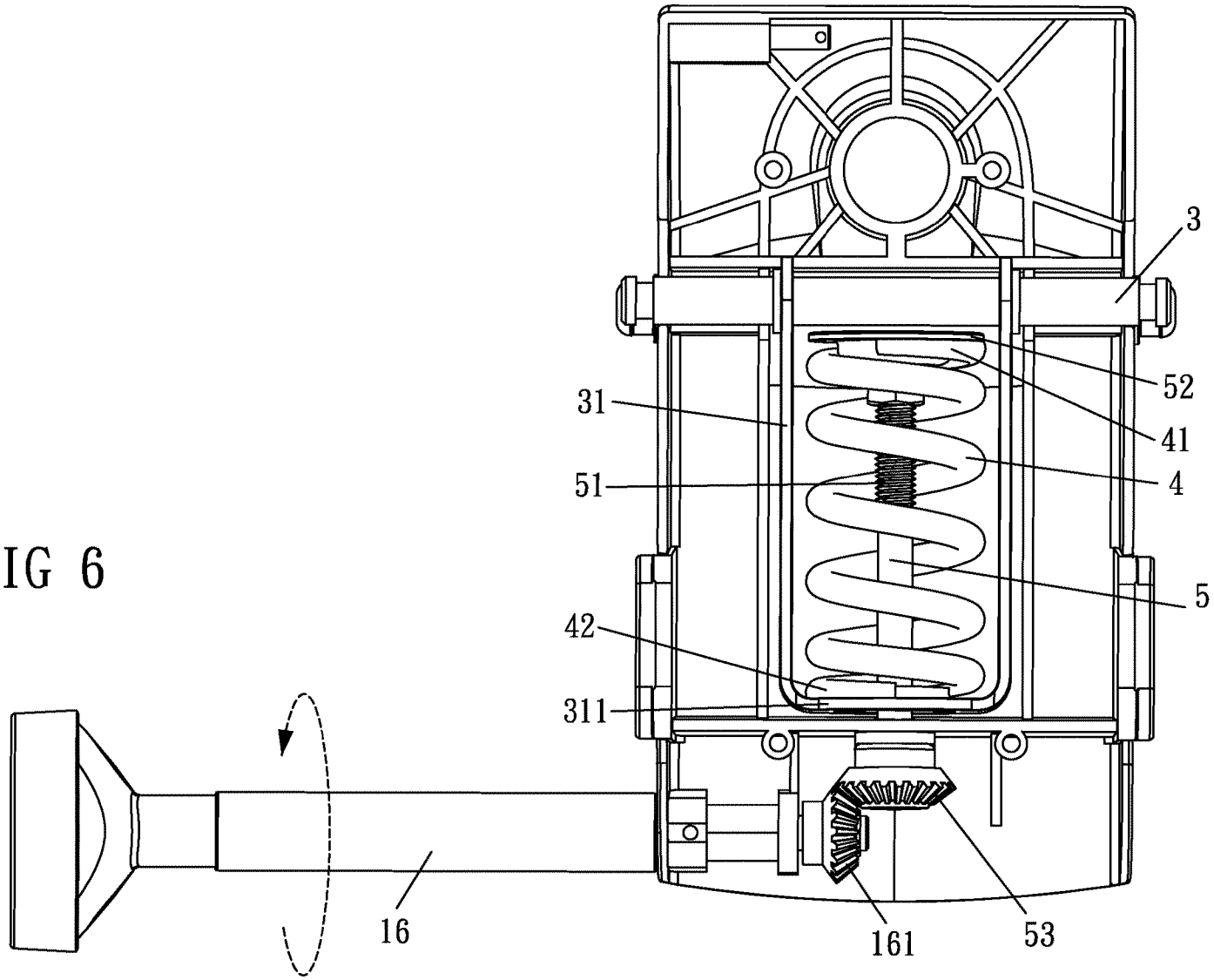
FIG. 6 is a top view of the invention, which shows elasticity of the spring is adjusted by the driving rod.

To make flexibility of the spring 4 adjustable, the base 1 is further provided with a driving rod 16. An end of the driving rod 16 is formed with an active gear 161 engaging with the passive gear 52 of the shaft 5. As shown in FIG. 6, by rotating the driving rod 16, the active gear 161 can rotate the shaft 5 to change the position of the pressing disk 52 and to adjust flexibility of the spring 4. As a result, users can adjust an extent of flexibility of support of the chair back A2 in advance.

Figure 7:
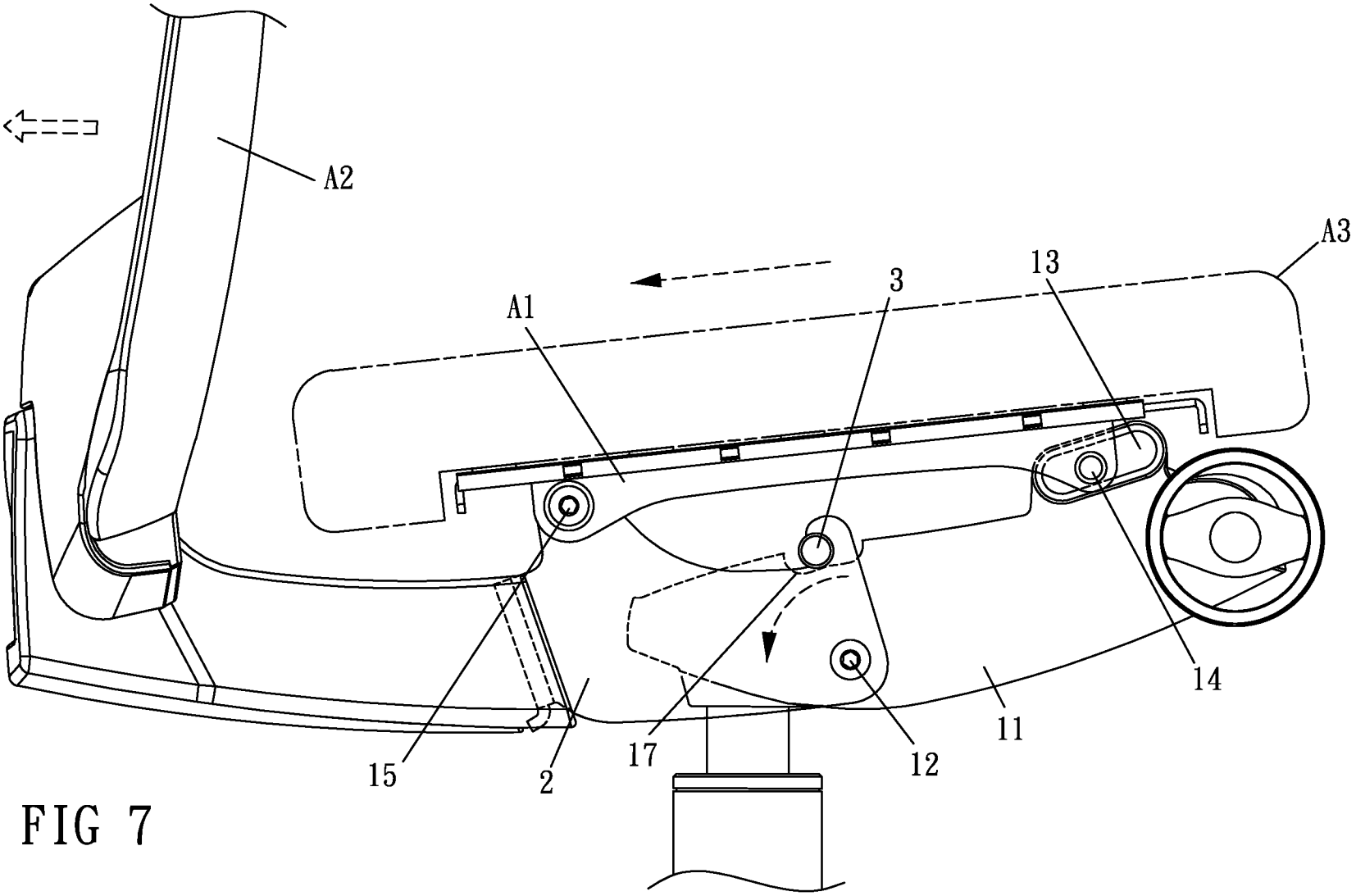
FIG. 7 is a schematic view of operation of the invention based on FIG. 5, which shows the cushion is synchronously moved when the chair back is tilted rearward.
Figure 8:
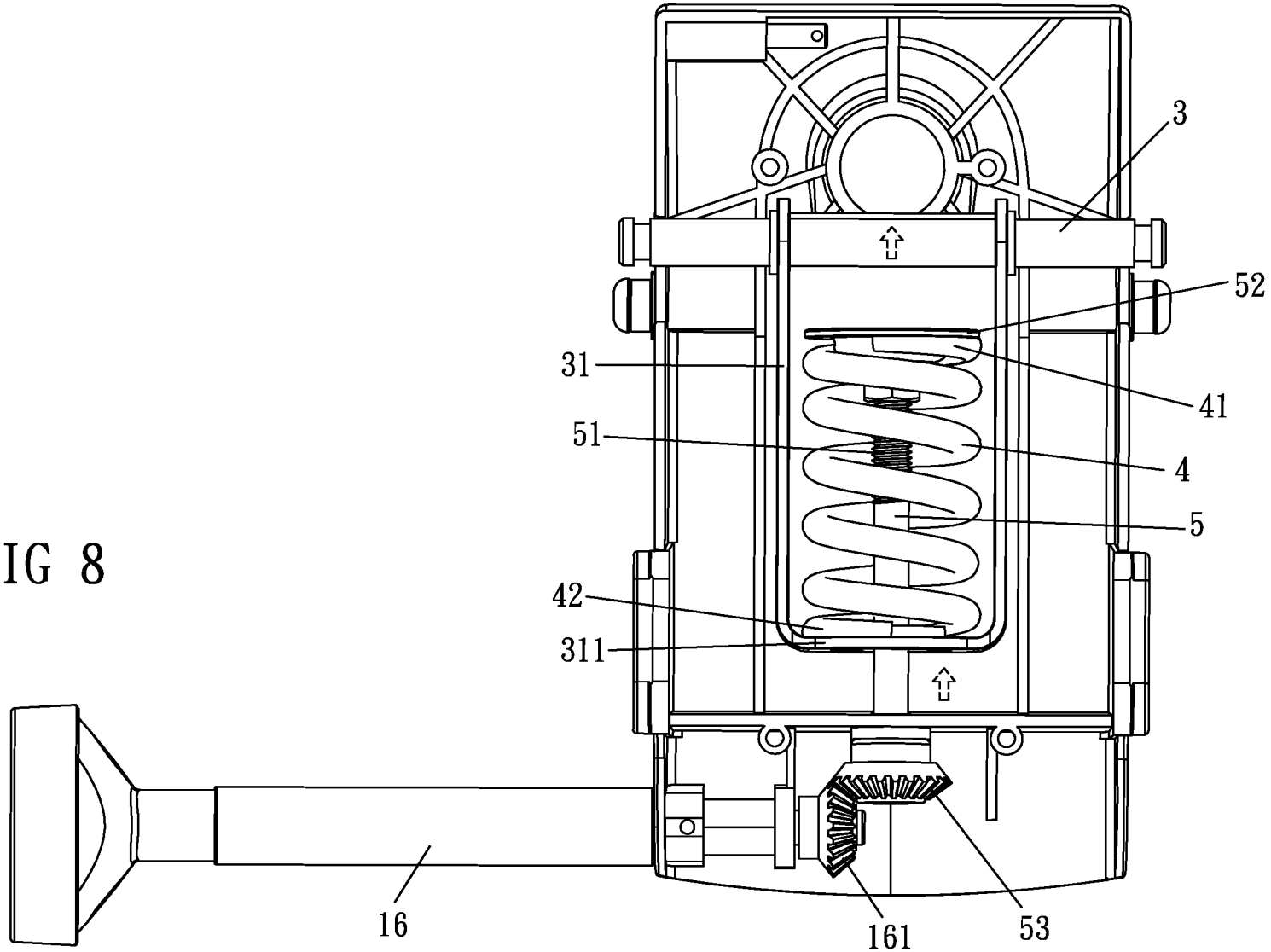
FIG. 8 is a schematic view of operation of the invention based on FIG. 6, which shows the spring is compressed by the frame drawn by the pulling rod when the chair back is tilted rearward.

Please refer to FIGS. 7 and 8. When the chair back is pressed to tilt rearward, the driving members are rotated to draw the pulling rod to move toward the chair back, and the action end of the frame is driven to compress the spring so as to make the chair back A2 flexibly supported.

When the chair back A2 is pushed rearward by a user, the force exerted on the chair back A2 makes the driving members 12 rotated. The guiding hole 13 offers the second pivot 14 a space to move so that the cushion A3 can synchronously move toward the chair back A2 as shown in FIG. 7. At the same time, the driving members 12 rotates on the first pivot 12 serving as a fulcrum to drive the pulling rod 3 to move toward the chair back A2, so that the action end 311 of the frame 31 connected to the pulling rod 3 will compress the spring 4 to generate flexible support to the chair back A2 as shown in FIG. 8. Such a design provides sufficiently flexible support. Also, the force exerted on the spring 4 adds an arm length between the first pivot 12 and the action end 311, so the torque generated by the tilted chair back A 2 will increased. This can save effort to overcome the resistance of compressing the spring 4.

What is claimed is:

1. A flexible support device for chair back tilting, comprising:

a pair of driving members for connecting to a chair back;

a base, having a pair of partition plates separately corresponding to the driving members, wherein each of the driving members is pivotally connected to one of the partition plates with a first pivot;

a U-shaped frame, substantially horizontally received in the base, and having an action end;

a spring longitudinally received in the U-shaped frame, wherein an end of the spring is blocked by the action end of the U-shaped frame; and a pulling rod, passing through both the base and two outer ends of the U-shaped frame, and two ends of the pulling rod separately connected to two free ends of the two driving members;

thereby when the chair back is pressed to tilt rearward, the driving members are rotated to draw the pulling rod to move rearward, and the action end of the frame is driven by the pulling rod to compress the spring so as to make the chair back flexibly supported.

2. The flexible support device of claim 1, wherein each of the partition plates is formed with a guiding hole which is located away from the driving members, each of the guiding holes is passed by a second pivot to connect with a bottom of a cushion, and the guiding holes allow the second pivots to move therein, and each of two ends of the driving members is pivotally connected to the bottom of the cushion with a third pivot to make the driving members rotatable relative to the cushion.

3. The flexible support device of claim 2, wherein the first pivot is lower than the second pivot and the third pivot in position.

4. The flexible support device of claim 2, wherein a width of the guiding hole is wider than a diameter of the second pivot.

5. The flexible support device of claim 2, wherein the action end is formed with a through hole for receiving a shaft to assemble the U-shaped frame into the base, and the spring is put around the shaft.

6. The flexible support device of claim 5, wherein an end of the shaft is formed with a thread for threadedly connecting a pressing disk which blocks another end of the spring.

7. The flexible support device of claim 6, wherein another end of the shaft is provided with a passive gear, and an end of the driving rod is formed with an active gear engaging with the passive gear.

8. The flexible support device of claim 1, wherein the free ends of the driving members are formed with hooks for hooking the pulling rod.

9. The flexible support device of claim 1, wherein two limiting troughs corresponding to the pulling rod are formed in the base to receive the pulling rod so as to limit the pulling rod, and a width of each of the limiting troughs is greater than a diameter of the pulling rod.

* * * * *